United States Patent [19]

Nussbaum

[11] Patent Number: 4,546,818

[45] Date of Patent: Oct. 15, 1985

[54] MULTIPLE SOURCE ENERGY RECOVERY SYSTEM

[75] Inventor: Otto J. Nussbaum, Huntsville, Ala.

[73] Assignee: Halstead Industries, Inc., Scottsboro, Ala.

[21] Appl. No.: 437,492

[22] Filed: Oct. 28, 1982

[51] Int. Cl.[4] ..... F28F 1/32

[52] U.S. Cl. ..... 165/47; 165/70; 165/140; 165/104.19; 165/135

[58] Field of Search ..... 165/140, 104.19, 104.11, 165/104.11 A, 70, 47; 126/437, 427

[56] References Cited

U.S. PATENT DOCUMENTS

| | | | |
|---|---|---|---|
| 4,008,709 | 2/1977 | Jardine | 126/427 |
| 4,256,475 | 3/1981 | Schafer | 165/140 |
| 4,265,094 | 5/1981 | Haasis, Jr. | 165/70 |
| 4,319,630 | 3/1982 | Hronek et al. | 165/70 |
| 4,325,357 | 4/1982 | Wormser | 126/437 |

*Primary Examiner*—Albert W. Davis, Jr.

*Attorney, Agent, or Firm*—Hubbard, Thurman, Turner & Tucker

[57] ABSTRACT

A multiple source energy recovery system incorporating a finned heat exchanger having a plurality of primary fluid circuits, at least some of which are connected to waste heat sources. A heated medium in a secondary fluid circuit is stored in a tank and then circulated to a second heat exchanger where the waste heat is recovered and utilized.

5 Claims, 4 Drawing Figures

MULTIPLE SOURCE ENERGY RECOVERY SYSTEM

BACKGROUND OF THE INVENTION

The present invention relates to a system for storing heat derived from a plurality of independent sources. Such systems generally are not new; however prior art systems of this type suffer from a number of disadvantages. For example, one prior art system requires a storage tank with a multiplicity of heat exchangers which are inserted into a storage vessel. This results in a cumbersome assembly which requires a substantial amount of heat transfer surface for each heat exchanger because of the fact that the water in the storage vessel is practically stagnant. As a result, heat transfer from the heat exchanger to the storage fluid is slow and inefficient.

SUMMARY OF THE INVENTION

The present invention provides a multiple energy storage recovery system which eliminates the disadvantages of prior art systems. Specifically, and in accordance with the invention, the heat exchangers are not inserted into a storage vessel but rather are combined into a single unit which may be built into a packaged, compact assembly. Water from a storage tank is pumped through the heat exchanger where it is in heat transfer contact with separate tube bundles, each supplied with a heat transfer fluid from an individual heat source. The heat exchanger may be either a shell-and-tube heat exchanger with individual tube bundles; or it may be a finned coil heat exchanger. The finned coil heat exchanger, a novel idea which was introduced some years ago, has not found wide acceptance because it was thought to be less efficient than shell-and-tube devices. One of its major advantages, however, is that the heat transfer fluids are completely isolated from the storage fluid which is an important consideration, particularly when potable water is heated. To prevent contamination, many plumbing codes require two tube wall separations between the heat transfer fluid and the heated water. This requirement is met by the finned coil heat exchanger but not by shell-and-tube or tube-in-tube heat exchangers.

The finned coil heat exchanger structure is the same as that of an ordinary air heating and cooling coil in which the fins are exposed to a moving airstream and transfer heat by convection from the air to the fluid within the coil or vice versa. In the finned coil heat exchanger of the present invention, the fins are not in contact with any airstream and serve only to transfer heat from one tube to an ajacent tube by conduction and radiation. For this reason, the entire finned coil assembly is usually insulated so as not to transfer heat to the surroundings. This requirement, however, is not mandatory because in certain instances the surrounding air may also serve as a heat source.

The above and other objects and features of the invention will become apparent from the following detailed description taken in connection with the accompanying drawings which form a part of this specification, and in which.

Figure 1:
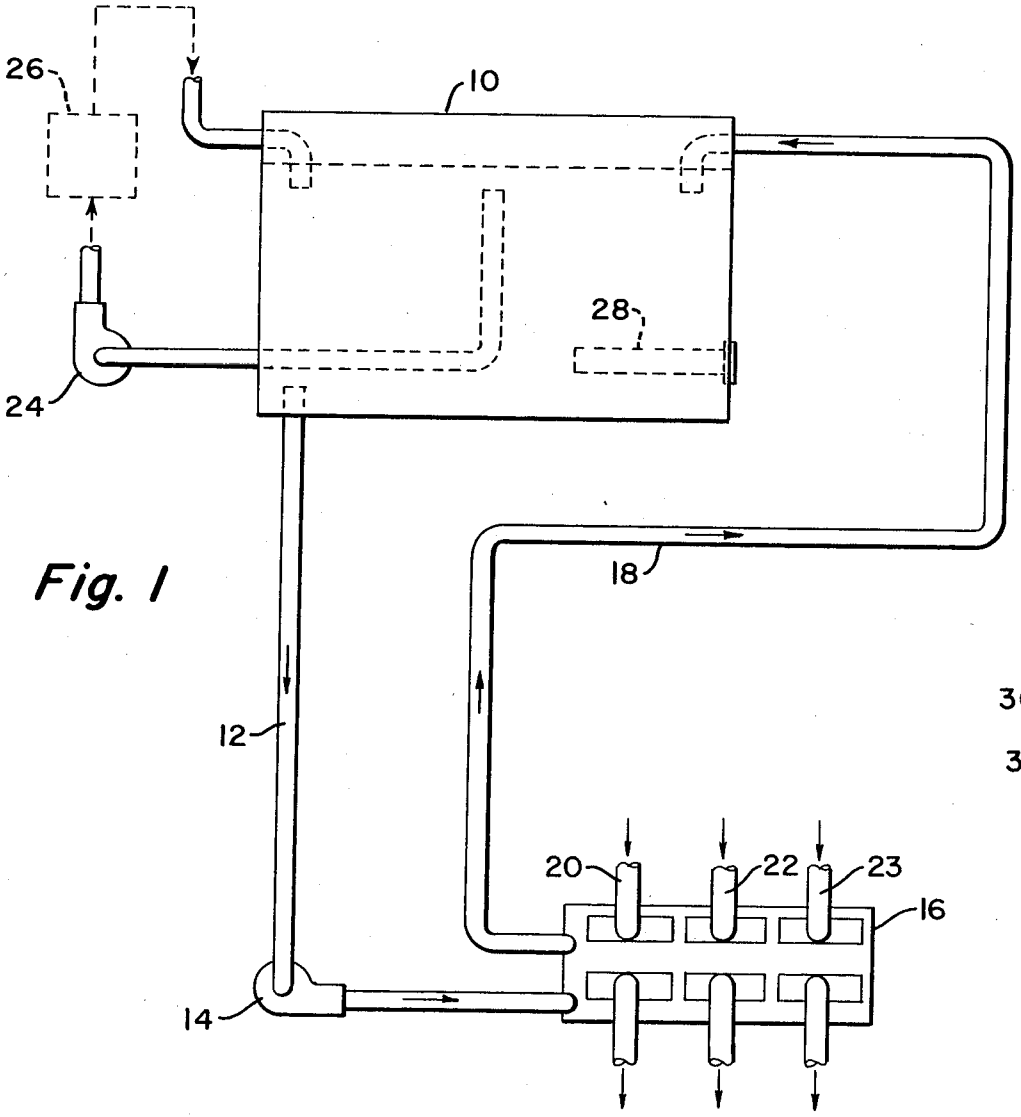
FIG. 1 is a schematic diagram of the energy recovery system of the invention.

With reference now to the drawings, and particularly to FIG. 1, there is shown an insulated storage tank 10 which may, for example, contain water which acts as the heat storage medium. Cooler water at the bottom of the tank 10 is pumped through a conduit 12 and pump 14 to a heat exchanger 16. After passing through the heat exchanger 16, water is then pumped back to the tank 10 through conduit 18. The conduits 12 and 18 comprise a secondary fluid circuit for the heat exchanger 16. In accordance with the present invention, there is a plurality of primary circuits 20, 22 and 23 each connected to a separate source of heat. For example, circuit 20 may be connected to a source of waste hot water; circuit 22 may be connected to a source of waste steam; while circuit 23 may be connected to a solar heat exchanger. The heat from the primary circuits 20, 22 and 23 is transferred to the liquid in the secondary circuit and pumped back to the tank 10. Water in tank 10 can then be pumped through pump 24 to a second heat exchanger 26 where the heat recovered from the primary circuits in heat exchanger 16 is utilized. Heat exchanger 26 may, for example, be a hot water heating coil used in a central air-handling unit. If desired or necessary, an off-peak electric resistance or other type immersion heater and thermostat combination 28 may be inserted through the wall of the tank 10 to heat the medium therein when insufficient heat is available from heat exchanger 16.

Figure 2:
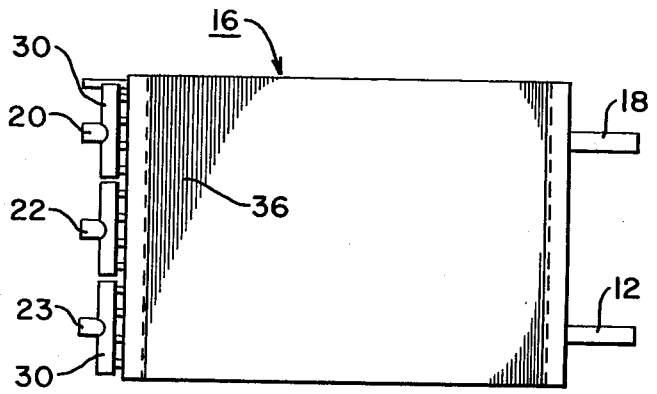
FIG. 2 is a side view of a type of finned heat exchanger which may be used in the invention.
Figure 3:
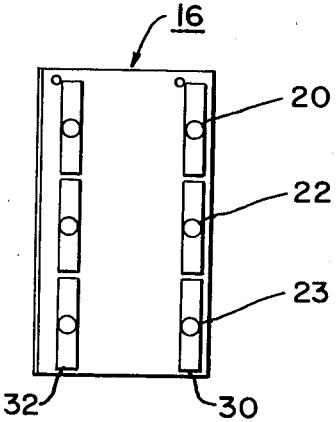
FIG. 3 is an end view of the heat exchanger of FIG. 2.
Figure 4:
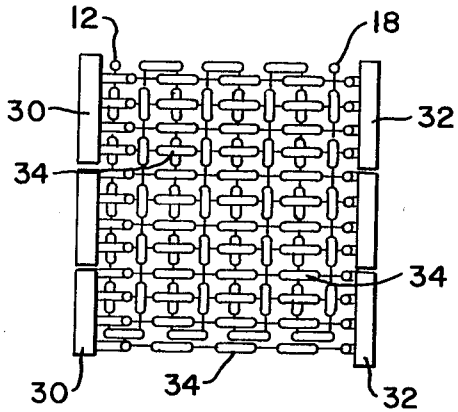
FIG. 4 illustrates the primary and secondary fluid circuits incorporated into the heat exchanger of FIGS. 2 and 3.

The details of the heat exchanger 16 are shown in FIGS. 2–4. Each primary circuit 20, 22 and 23 includes an input header 30 and an output header 32. Each of the headers, in turn, is connected to the opposite ends of tubes 34 (FIG. 4) extending through fins 36. The secondary circuit comprises tube sections arranged in a serpentine configuration and connected at its opposite ends to the conduits 12 and 18. As explained above, cool water from the tank 10 flows into the secondary circuit formed of tube sections via conduit 12 and leaves via conduit 18. As was explained above, the heat exchanger 16 may be provided with insulation or may be exposed to a heated airflow (e.g., exhaust gases from a furnace) which passes through the fins 36.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A multiple source energy recovery system comprising a heat exchange medium, a storage tank for said heat exchange medium, a plurality of separate heat-bearing fluid sources, a first heat exchanger having a plurality of primary fluid circuits permanently connected to respective ones of said heat-bearing fluid sources, a secondary fluid circuit in said first heat exchanger for circulating said heat exchange medium between said first heat exchanger and said storage tank, said first heat exchanger comprising a finned coil heat exchanger through which said primary and secondary circuits extend, said primary circuits including a plurality of respective input headers and output headers interconnected by tubes for conducting fluid through respective ones of said primary circuits, said secondary circuit comprising a serpentine tube extending between the tubes of each of said primary circuit, said primary and secondary circuits being physically separated but thermally interconnected by fins of said first heat exchanger and said primary circuits are each physically separated from each other but said fins are common to all of said primary circuits and said secondary circuit, a second heat exchanger, and means for circulating said heat exchange medium between said storage tank and said second heat exchanger where heat recovered from said primary circuits is utilized.

2. The system of claim 1 including insulation surrounding the fins of said first heat exchanger to prevent heat from escaping to the atmosphere.

3. The system of claim 2 wherein a heated airstream passes through the fins of said first heat exchanger.

4. The system of claim 1 wherein at least some of said heat-bearing fluid sources comprise waste heat sources.

5. In a multiple source heat recovery system a storage tank for a heat exchange medium, a plurality of heat bearing fluid sources, a quantity of heat exchange fluid in said storage tank, means for circulating said heat exchange fluid to and from said storage tank for transferring heat from said heat bearing fluid sources to said storage tank, a finned coil heat exchanger including a plurality of primary fluid circuits connected to respective ones of said heat bearing fluid sources, and a secondary fluid circuit for conducting said heat exchange fluid between said finned coil heat exchanger and said storage tank, said primary fluid circuits including a plurality of respective input headers and output headers interconnected by tubes for conducting fluid through respective ones of said primary fluid circuits, said secondary fluid circuit comprising a serpentine tube extending between the tubes of each of said primary fluid circuits, said primary and secondary fluid circuits being physically separated one from the other but thermally interconnected by fins of said heat exchanger and wherein said fins are common to all of said primary fluid circuits and said secondary fluid circuit for conducting heat between said primary fluid circuits and said secondary fluid circuit.

* * * * *